US005222883A

United States Patent [19]

Fukanuma et al.

[11] Patent Number: 5,222,883

[45] Date of Patent: Jun. 29, 1993

[54] SCROLL TYPE COMPRESSOR HAVING THE CENTER OF THE CYLINDRICAL SHELL DISPLACED FOR COMPACTNESS

[75] Inventors: Tetsuhiko Fukanuma; Yuji Izumi; Tatsushi Mori; Tetsuo Yoshida, all of Kariya, Japan

[73] Assignee: Kabushiki Kaisha Toyoda Jidoshokki Seisakusho, Kariya, Japan

[21] Appl. No.: 841,377

[22] Filed: Feb. 25, 1992

[30] Foreign Application Priority Data

Mar. 6, 1991 [JP] Japan ..... 3-40279

[51] Int. Cl.[5] ..... F04C 18/04

[52] U.S. Cl. ..... 418/55.2

[58] Field of Search ..... 418/55.2, 150

[56] References Cited

U.S. PATENT DOCUMENTS 4,303,379 12/1981 Hiraga et al. ..... 418/55.2
4,304,535 12/1981 Terauchi ..... 418/55.2
4,477,239 10/1984 Yoshii et al. ..... 418/55.2
4,494,914 1/1985 Shiibayashi ..... 418/55.2

FOREIGN PATENT DOCUMENTS 0010402 4/1980 European Pat. Off. .
55-51987 4/1980 Japan .
63-201381 8/1988 Japan ..... 418/55.2
1-211601 8/1989 Japan ..... 418/55.2

*Primary Examiner*—John J. Vrablik
*Attorney, Agent, or Firm*—Brooks Haidt Haffner & Delahunty

[57] ABSTRACT

A relatively small diameter scroll type compressor is disclosed. The axial center of the compressor's shell is displaced from the involute center of the fixed spiral element in a direction towards the base end portion of the orbital scroll. More specifically, the displacement distance (X) is in the range of: $\frac{1}{2}R_{or}<X\leqq\frac{1}{2}R_{or}+\frac{1}{2}(t+c)$, wherein "t" is the thickness of a base end portion of the orbiting spiral element and "c" is the minimum clearance between an outer wall of the orbital scroll's base end portion and the inner wall of the shell.

8 Claims, 5 Drawing Sheets

SCROLL TYPE COMPRESSOR HAVING THE CENTER OF THE CYLINDRICAL SHELL DISPLACED FOR COMPACTNESS

BACKGROUND OF THE INVENTION

1. Field of the Invention

The present invention relates to a scroll type compressor and more particularly, to an improvement for making a compressor more compact.

2. Description of the Related Art

Conventional scroll type compressors (hereinafter simply referred to as "compressors"), have a fixed scroll that is fixed in a shell and an orbiting scroll that is supported for revolving movement in the shell. The fixed scroll includes a fixed end plate and a fixed spiral element formed integrally with one side of the fixed end plate. The inner and outer walls of the fixed spiral element form involute curves. The orbiting scroll includes an orbiting end plate and an orbiting spiral element formed integrally with one side of the orbiting end plate. The inner and outer walls of the orbiting spiral element also take the form of involute curves. The fixed spiral element and orbiting spiral element are joined with the phase of the latter spiral element shifted by 180° from that of the former spiral element. A compression chamber is therefore formed between the scrolls.

In a compressor of this type, rotation of a drive shaft causes revolution of the orbiting scroll. Consequently, the compression chamber moves toward the center while its volume is decreased, thereby discharging a compressed fluid into a discharge chamber.

Further, as shown in FIG. 4, the inner wall of a fixed spiral element 82 from a tip portion 82*b* to a base portion 82*a* is formed along an inner involute curve $I_{in}$. The outer wall of the fixed spiral element 82 is formed along an outer involute curve $I_{out}$. This outer wall extends from the tip portion 82*b* to a position where the involute angle of this position is smaller by almost 180° than that of the base portion 82*a*. Since the outer wall of the fixed spiral element 82 is connected to an arc E that forms the inner wall of a shell 81, the fixed spiral element 82 is connected integrally with the shell 81. The inner and outer walls of an orbiting spiral element 83 are likewise formed along the involute curves $I_{in}$ and $I_{out}$, respectively.

According to this compressor, the orbiting spiral element 83 and fixed spiral element 82 must be made to contact each other within a predetermined involute angle in accordance with revolution of the orbiting scroll in order to form the compression chamber. The center O of the shell 81 is designed to be coincident with the center $S_O$ of an involute generating circle S for the fixed spiral element 82. In addition, the center $P_O$ of an involute generating circle P for the orbiting spiral element 83 moves on a revolution circle C concentric to the center O (center $S_O$) of the shell 81, permitting the orbiting scroll to revolve.

However, when the center O of the shell 81 coincides with the center $S_O$ of the involute generating circle S for the fixed spiral element 82, a wasted space will be formed between the inner wall of the base portion 82*a* of the fixed spiral element 82 and the inner wall of the shell 81. This will be discussed more specifically below.

A distance $W_8$ between the inner wall of the base portion 82*a* of the fixed spiral element 82 and the inner wall of the shell 81 is expressed by the following equations:

$$a+W_8=R_{or}+a+t+c$$

$$W_8=R_{or}+t+c$$

where t: is the thickness of the base portion 83*a* of the orbiting spiral element 83, c: is the minimum clearance between the outer wall of the base portion 83*a* and the inner wall of the shell 81, a: is the distance between the center $P_O$ of the involute generating circle P for the orbiting spiral element 83 and the inner wall of the base portion 83*a* of the orbiting spiral element 83 (=distance between the center $S_O$ of the involute generating circle S for the fixed spiral element 82 and the inner wall of the base portion 82*a* of the fixed spiral element 82, and $R_{or}$: is the radius of orbital revolution.

The minimum diameter $D_8$ of the shell 81 is therefore expressed as follows:

$$D_8=2(a+R_{or}+t+c).$$

This conventional type of compressor therefore has a wasted space formed inside, increasing the diameter of the shell 81, which inevitably requires larger space to mount the compressor in a vehicle or the like.

One attempt to reduce this shortcoming is the compressor shown in FIG. 5, which is disclosed in Japanese Unexamined Patent Publication No. 55-51987. In this compressor, the center O of a shell 91 is shifted by $R_{or}/2$ from the center $S_O$ of the involute generating circle S for a fixed spiral element 92 in a direction opposite to the direction toward a base portion 92*a* of the fixed spiral element 92. In the compressor disclosed in this Japanese publication, the inner and outer walls of the fixed spiral element 92 and an orbiting spiral element 93 are also formed along the involute curves $I_{in}$ and $I_{out}$, respectively. As the center $P_O$ of the involute generating circle P for the orbiting spiral element 93 moves on a revolution circle C concentric to the involute generating circle S for the fixed spiral element 92, the orbiting scroll revolves.

With t, c, a and $R_{or}$ defined as given above, a distance $W_9$ between the inner wall of the base portion 92*a* of the fixed spiral element 92 and the inner wall of the shell 91 is expressed by the following equations:

$$R_{or}/2+a+W_9=R_{or}-R_{or}/2+a+t+c$$

$$W_9=t+c$$

The minimum diameter $D_9$ of the shell 91 is expressed by:

$$D_9=2(a+R_{or}/2+t+c).$$

This compressor can therefore reduce the wasted space by an amount expressed by the following equation as compared with the above-described typical compressor.

$$W_8 - W_9 = R_{or} + t + c - (t + c) = R_{or}$$

Likewise, the minimum diameter of the shell can be reduced by an amount expressed by the following equation.

$$D_8 - D_9 = 2(a + R_{or} + t + c) - 2(a + R_{or}/2 + t + c) = R_{or}$$

As apparent from the above, the compressor can be made more compact, so that this compressor is more easily mounted in a vehicle or the like than the aforementioned compressor.

However, the compressor disclosed in the above publication still has a wasted space $W_9$ expressed by the formula:

$$W_9 = t + c$$

The wasted space is between the inner wall of the base portion 92a of the fixed spiral element 92 and the inner wall of the shell 91. The minimum diameter of the shell 91 is thus limited to:

$$D_9 = 2(a + R_{or}/2 + t + c)$$

Accordingly, the disclosed compressor is not an adequate solution to the wasted space problem.

SUMMARY OF THE INVENTION

It is therefore an object of the present invention to provide a compressor which is designed to have as small a wasted space as possible between the inner wall of the base portion of its fixed spiral element and the inner wall of its shell, and to have a smaller minimum diameter for further improvement on the mounting of the compressor into a vehicle or the like.

To achieve this object, a compressor embodying the present invention has interleaved fixed and orbiting spiral elements that have substantially involute shaped curves. The orbiting spiral element is revolved relative to the fixed spiral element at an orbital radius $R_{or}$, with its rotation restricted. As the orbiting spiral element revolves, the volume of a compression chamber between the spiral elements decreases. Accordingly, a fluid in the compression chamber is compressed to then be discharged outside the shell.

The axial center (O) of the shell is displaced from the involute center ($S_O$) of the fixed spiral element in a direction towards the base end portion of the orbital scroll by a displacement distance (X) in the range of, $$\tfrac{1}{2}R_{or} < X \leqq \tfrac{1}{2}R_{or} + \tfrac{1}{2}(t + c)$$

wherein "t" is the thickness of a base end portion of the orbiting spiral element and "c" is the minimum clearance between an outer wall of the orbital scroll's base end portion and the inner wall of the shell.

In a preferred embodiment, the maximum diameter of the orbiting spiral element ($D_O$) is substantially expressed by the equation: $(D_O) = 2a + t = (c + R_{or})$, wherein "a" is the distance between the center of the involute generating circle for the orbiting spiral element and the inner wall of the base portion of the orbiting spiral element. In another preferred embodiment, the maximum inner diameter of the shell ($D_s$) is substantially expressed by the equation: $D_s = 2a + t + c + R_{or}$.

BRIEF DESCRIPTION OF THE DRAWINGS

The invention, together with objects and advantages thereof, may best be understood by reference to the following description of the presently preferred embodiments together with the accompanying drawings in which.

DETAILED DESCRIPTION OF THE PREFERRED EMBODIMENTS

First and second embodiments of the present invention will now be described referring to the accompanying drawings.

First Embodiment

Figure 1:
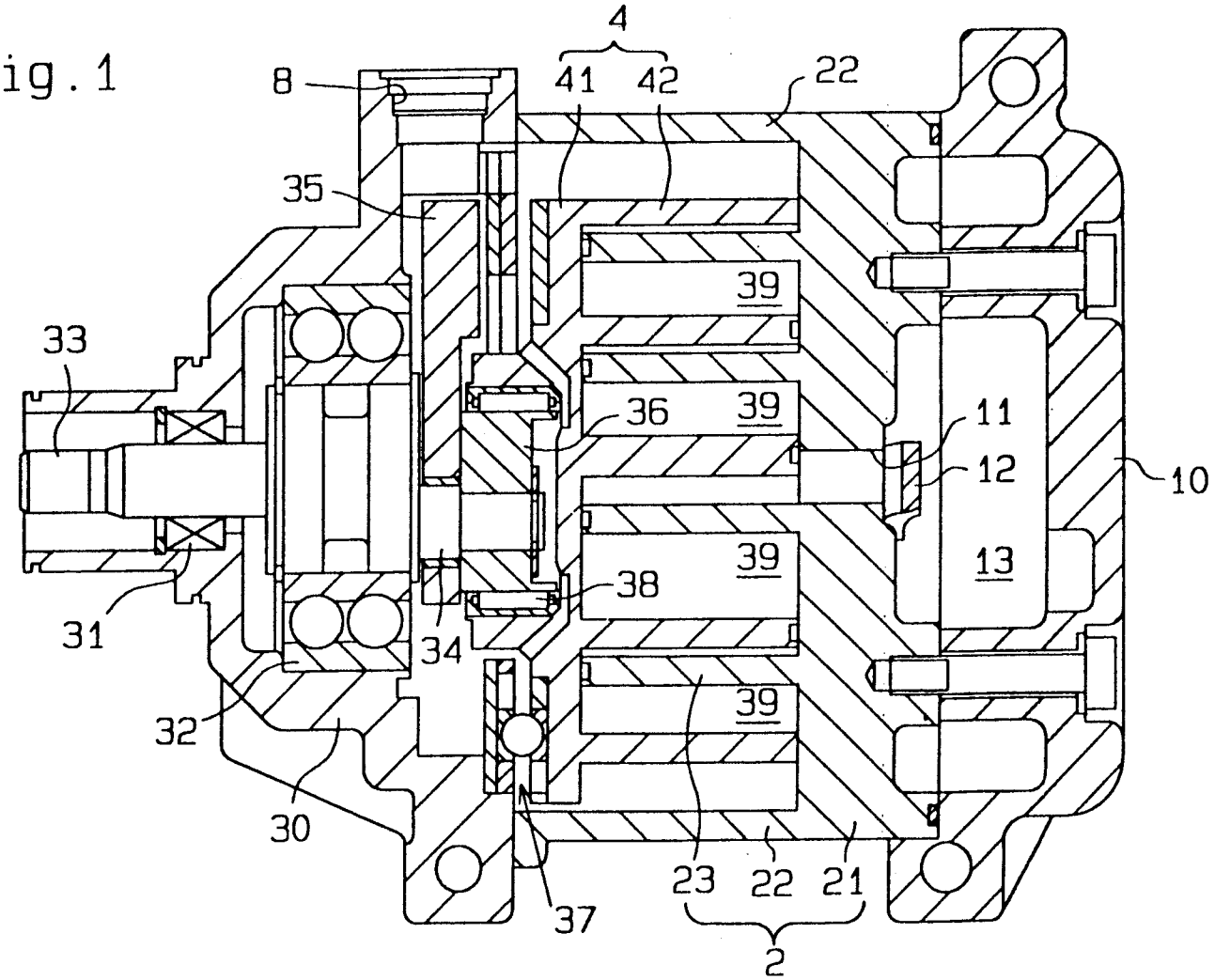
FIG. 1 is a longitudinal cross section of a compressor according to a first embodiment of the present invention.

In the first embodiment of the invention shown in FIG. 1, a fixed scroll 2 includes a disk-shaped fixed end plate 21, a shell 22 formed integrally with the fixed end plate 21, and a fixed spiral element 23 formed on one side the fixed end plate 21. An orbiting scroll 4 includes a disk-shaped orbiting end plate 41 shown in FIG. 1, and an orbiting spiral element 42 formed on a side the orbiting end plate 41 that faces the fixed scroll.

When the fixed scroll 2 is joined with the orbiting scroll 4, a plurality of compression chambers 39 are formed. The shell 22 of the fixed scroll 2 serves as the outer housing of the compressor. A front housing 30 is coupled to the shell 22 by a tightening means.

In the front housing 30, a drive shaft 33 is rotatably supported by bearings 31 and 32. An eccentric pin 34 is provided at the inner end of a larger diameter portion of the drive shaft 33 at a position eccentric from the axis of the drive shaft 33. A bushing 36 is fitted over the eccentric pin 34. The orbiting scroll 4 is supported by the bushing 36 through a bearing 38, and only the revolution of the orbiting scroll 4 is allowed by the cooperation of the bushing 36 with a rotation preventing device 37. A counter weight 35 is attached to the eccentric pin 34 to absorb the dynamic imbalance of the orbiting scroll 4. The rotation preventing device 37 is linked through its movable ring to the orbiting end plate 41.

A discharge port 11, which communicates with the compression chambers 39 in a discharge process, is formed through the center portion of the fixed end plate 21 of the fixed scroll 2. A rear housing 10 having a discharge chamber 13 therein is fixed in the fixed scroll 2. The discharge port 11 communicates through a discharge valve 12 with the discharge chamber 13, which communicates with an external system such as a refrigeration circuit (not shown). A suction port 8, formed through the front housing 30, faces the peripheral portion of the counter weight 35 and communicates with the external system.

Figure 2:
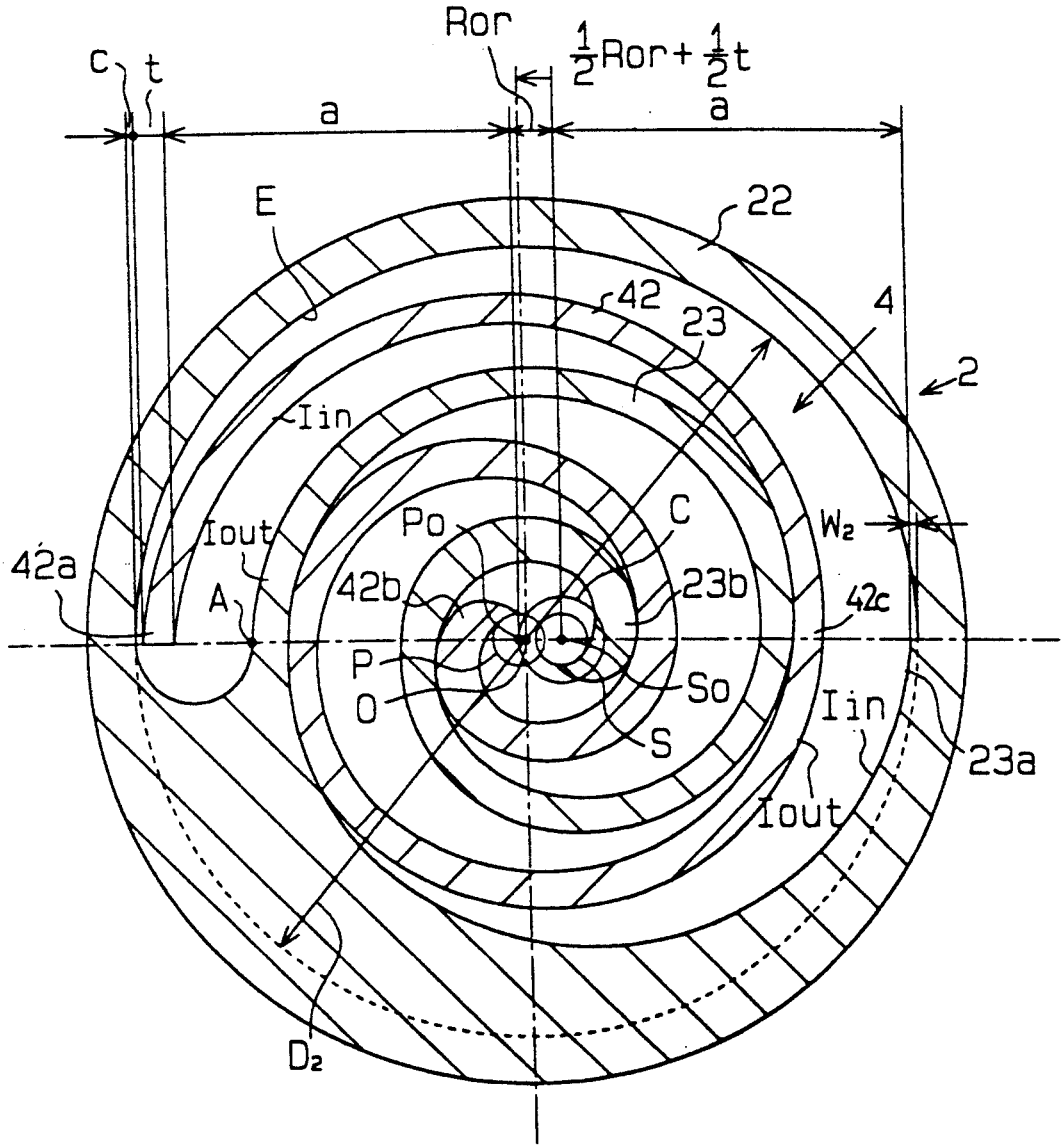
FIG. 2 is a lateral cross section of the compressor according to the first embodiment.

The fixed spiral element 23 of the fixed scroll 2 is formed along an involute curve defined by an involute generating circle S for a center $S_O$ as shown in FIG. 2. The inner wall of the fixed spiral element 23 from a tip portion 23b to a base portion 23a is formed along an inner involute curve $I_{in}$. The outer wall of the fixed spiral element 23 is formed along an outer involute curve $I_{out}$, and extends from the tip portion 23b to the vicinity of an involute point A whose involute angle is smaller by 180° than that of the base portion 23a. The inner wall of the shell 22 is formed along an arc E with a point O as a center.

The outer wall of the fixed spiral element 23 is connected to the inner wall (arc E) of the shell 22 through a small arched wall at the involute point A of the outer involute curve $I_{out}$. The fixed spiral element 23 is thus integrally formed with the shell 22. A broken line in FIG. 2 indicates part of the arc E at the portion where the fixed spiral element 23 and the shell 22 are formed integral with each other.

The inner and outer walls of the orbiting spiral element 42 from a tip portion 42b to a base portion 42a are formed respectively along the inner and outer involute curves $I_{in}$ and $I_{out}$ based on an involute generating circle P for the center $P_O$.

In the thus constituted compressor the rotation of an engine (not shown) is transmitted via an electromagnetic clutch (not shown) to the drive shaft 33 shown in FIG. 1. Consequently, a revolution momentum is given to the orbiting scroll 4 by the cooperation of the bushing 36 with the rotation preventing device 37. That is, the center $P_O$ of the orbiting spiral element 42 in FIG. 2 moves clockwise on the revolution circle C concentric to the involute generating circle S for the fixed spiral element 23.

In the status shown in FIG. 2, refrigerant gas is sucked from the base portion 42a of the orbiting spiral element 42 to an intermediate portion 42c (position whose involute angle is smaller by 180° from the base portion 42a). If the orbiting scroll 4 revolves by 180° from the position shown in FIG. 2, the outer wall at the intermediate portion 42c starts contacting the base portion 23a of the fixed spiral element 23. In the subsequent revolution, the volumes of the compression chambers 39 in FIG. 1 change. As a result, the pressure of the refrigerant gas rises in the compression chambers 39 sequentially, opening the discharge valve 12, so that the refrigerant gas is discharged from the discharge port 11 to the discharge chamber 13.

Referring to FIG. 2, the sizes of the individual portions are expressed as follows:

- t: thickness of the base portion 42a of the orbiting spiral element 42,
- c: minimum clearance between the outer wall of this base portion 42a and the inner wall of the shell 22,
- a: distance between the center $P_O$ of the involute generating circle P for the orbiting spiral element 42 and the inner wall of the base portion 42a of the orbiting spiral element 42 (=distance between the center $S_O$ of the involute generating circle S for the fixed spiral element 23 and the inner wall of the base portion 23a of the fixed spiral element 23), and
- $R_{or}$: is the radius of orbital revolution.

In this case the center O of the shell 22 which is the center of the arc E is displaced by $R_{or}/2+t/2$ from the center $S_O$ of the involute generating circle S in a direction opposite to the direction toward the base portion 23a of the fixed spiral element 23.

Therefore, a distance $W_2$ between the inner wall of the base portion 23a of the fixed spiral element 23 and the inner wall of the shell 22, or wasted space in the compressor is expressed as follows:

$$W_2+R_{or}/2+t/2+a=R_{or}-(R_{or}/2+t/2)+a+t+c$$

$$W_2=R_{or}-(R_{or}/2+t/2)+a+t+c-(R_{or}/2+t/2+a)$$

$$W_2=c$$

The minimum diameter $D_2$ of the shell 22 is expressed as follows:

$$\begin{aligned} D_2 &= 2\{R_{or}-(R_{or}/2+t/2)+a+t+c\} \\ &= 2(a+R_{or}/2+t/2+c) \\ &= 2a+t+2c+R_{opr} \end{aligned}$$

This compressor can therefore reduce the wasted space by "t" as follows, as compared with the above-described compressor disclosed in the Japanese publication.

$$\begin{aligned} W_9-W_2 &= t+c-c \\ &= t \end{aligned}$$

Likewise, the minimum diameter of the shell can be reduced by "t" as follows.

$$\begin{aligned} D_9-D_2 &= 2(a+R_{or}/2+t+c)-2(a+R_{or}/2+t/2+c) \\ &= t \end{aligned}$$

With t=4 mm, for example, the minimum diameter of the shell can be reduced by 4 mm.

This compressor is therefore designed to have a smaller diameter and be lighter, further improving the ease of the mounting of the compressor into a vehicle or the like.

In the compressor according to the first embodiment, the inner and outer walls of each of the fixed and orbiting spiral elements 23 and 42 are formed respectively along the involute curves $I_{in}$ and $I_{out}$. Those inner and outer walls may be formed not along the inner and outer involute curves $I_{in}$ and $I_{out}$, but along curves whose distances from the respective centers decrease as the involute angle increases.

Further, the tip portions 23b and 42b of the fixed and orbiting spiral elements 23 and 42 may be formed along on arc to improve their strengths, thereby increasing the wall thicknesses.

Second Embodiment

Figure 3:
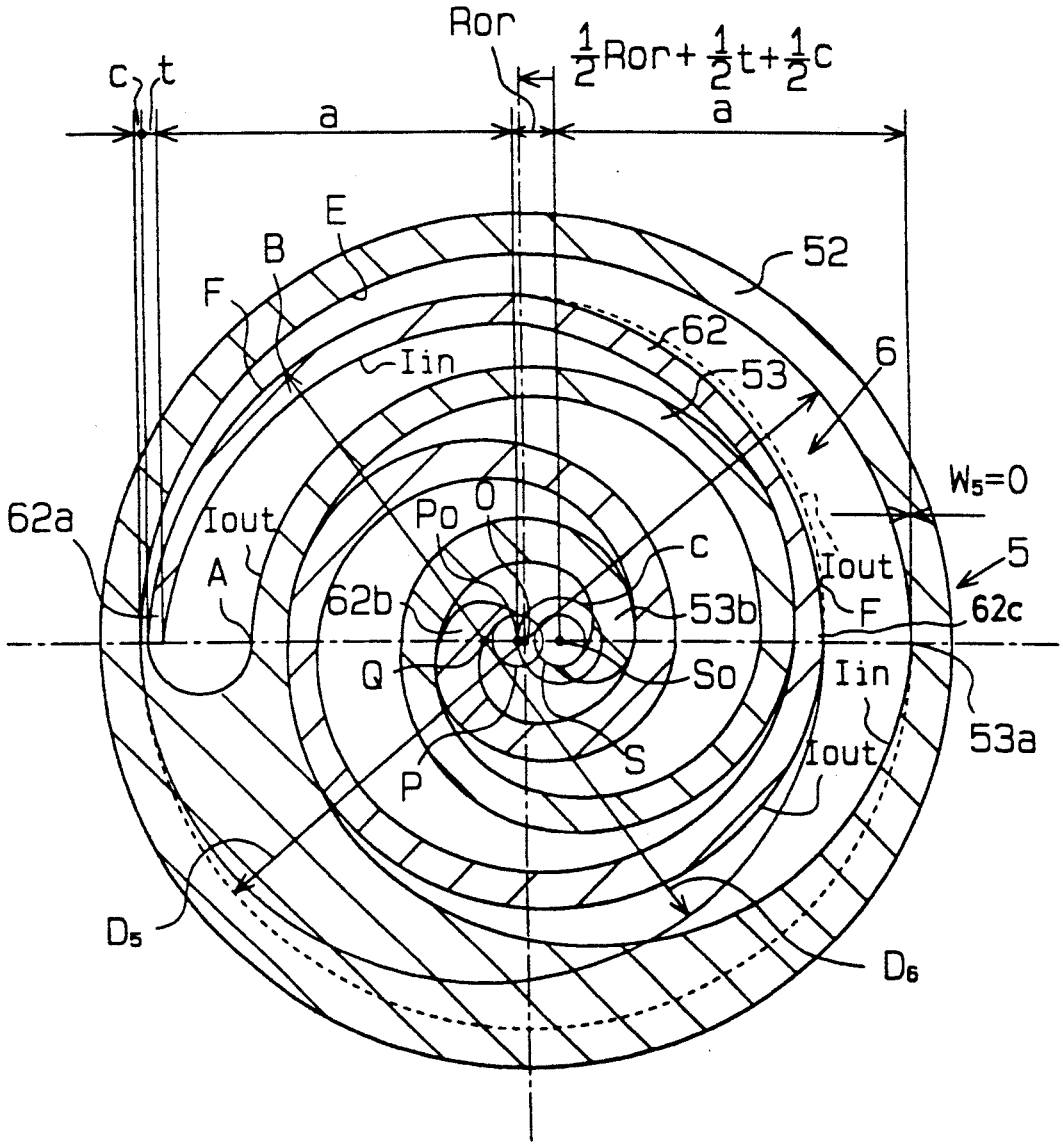
FIG. 3 is a lateral cross section of a compressor according to a second embodiment.
Figure 4:
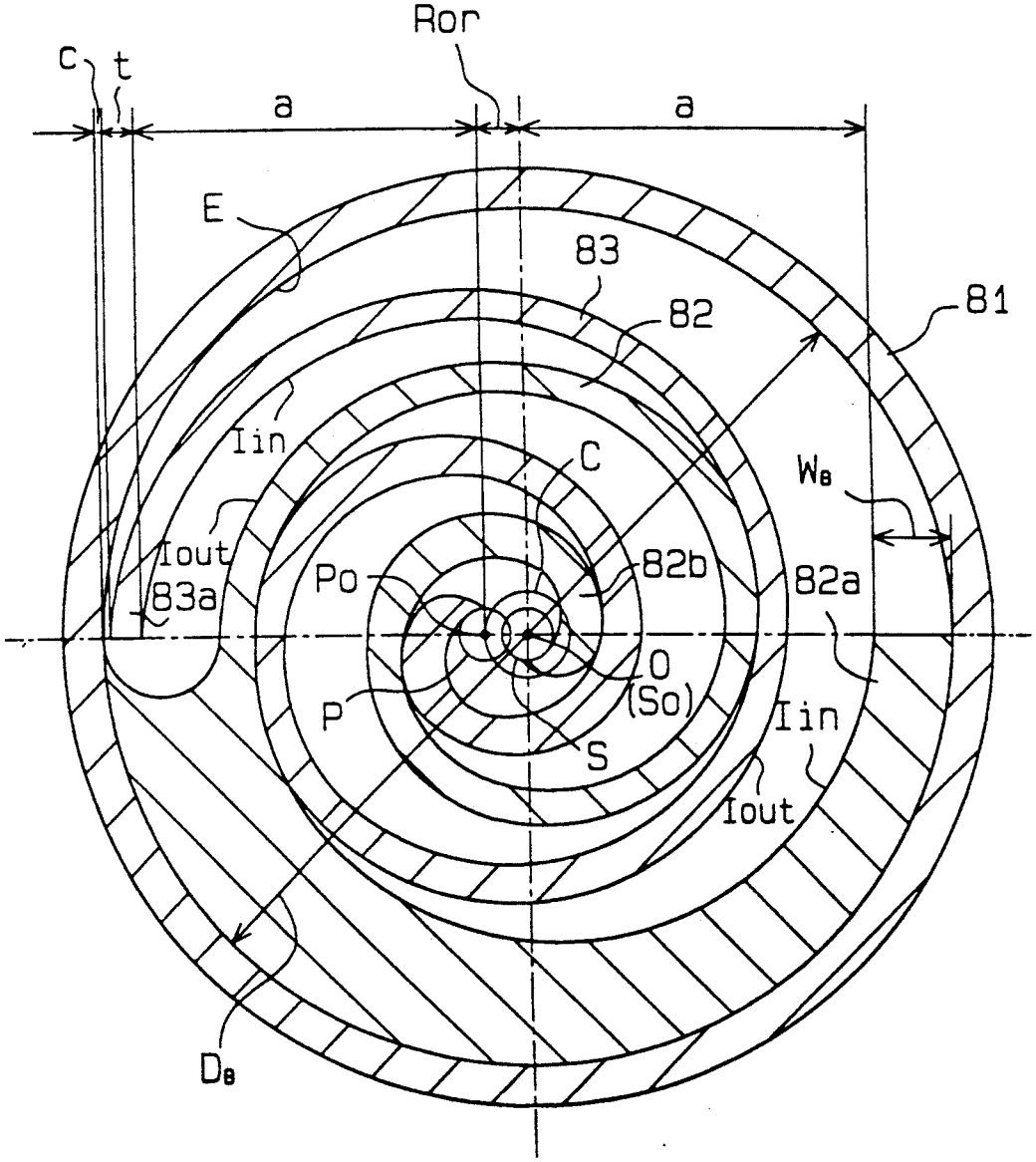
Fig. 4 (Prior Art)
FIG. 4 is a lateral cross section showing a typical prior art compressor design.
Figure 5:
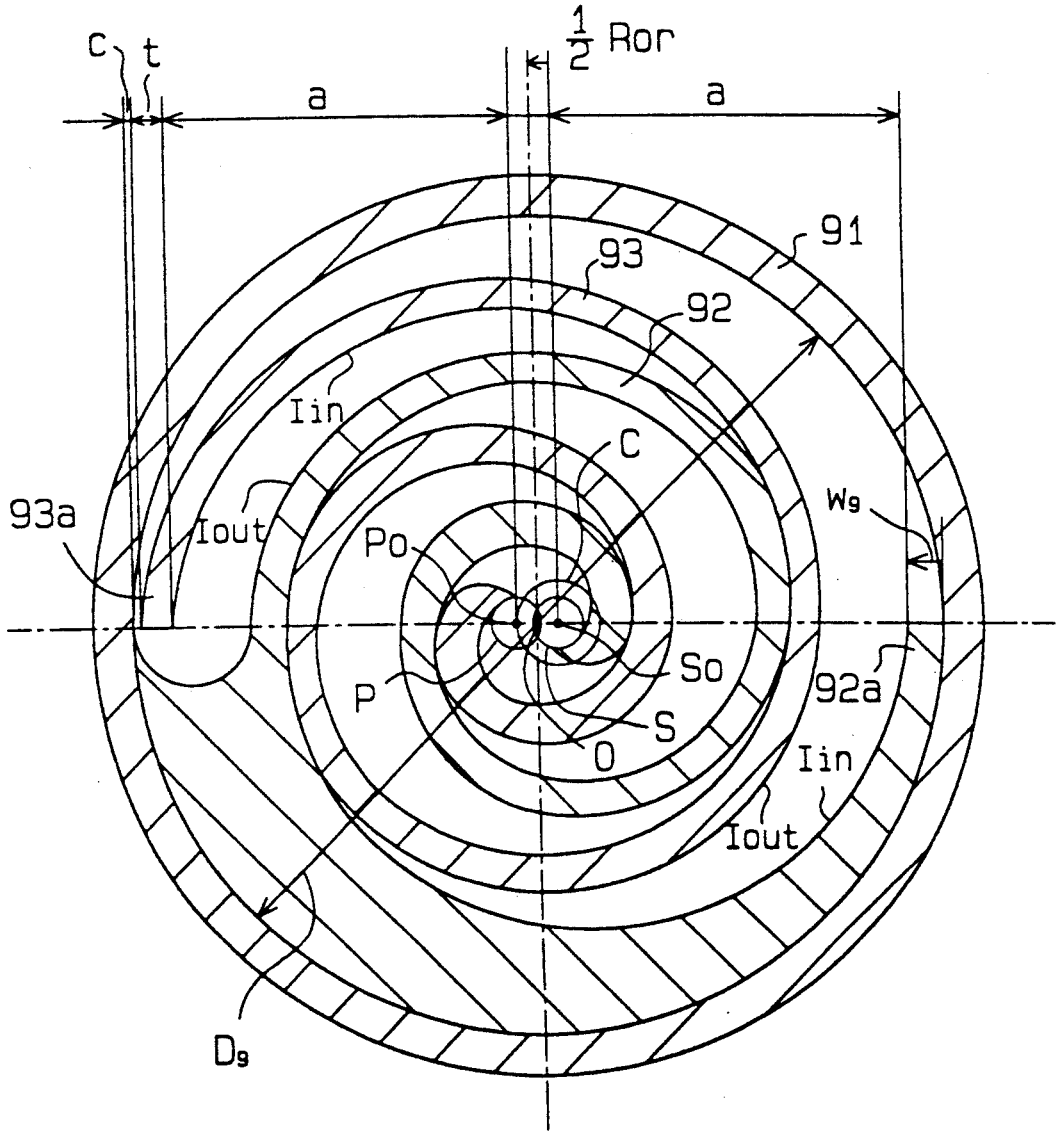
Fig. 5 (Prior Art)
FIG. 5 is a lateral cross section showing a second conventional compressor design.

As shown in FIG. 3, a compressor according to the second embodiment differs from the compressor according to the first embodiment in the shapes of its fixed spiral element 53, its shell 52, and its orbiting spiral element 62. Both embodiments are the same in the other structure, so that a description of the same structure will not be given below.

The inner and outer walls of the fixed spiral element 53 of the fixed scroll 5, like those of the first embodiment, are formed from a tip portion 53b to a base portion 53a along inner and outer involute curves $I_{in}$ and $I_{out}$. It is to be noted that the inner involute curve $I_{in}$ defining the inner wall of the fixed spiral element 53 is directly and smoothly coupled to an arc E that defines the inner wall of the shell 52, so that both inner walls are made integral. In FIG. 3, a broken line indicates part of the arc E at the portion where the fixed spiral element 53 and the shell 52 are formed integral with each other.

The inner wall of the orbiting spiral element 62 from a tip portion 62b to a base portion 62a is formed along the inner involute curve $I_{in}$. The outer wall of the fixed spiral element 62 from the tip portion 62b to an intermediate portion 62c short by an involute angle of 180° of the base portion 62a, is formed along the outer involute curve $I_{out}$. The portion from the intermediate portion 62c to the base portion 62a is formed along an arc F which has a radius equal to the distance between an involute point B and a point Q with Q as its center. The outer involute curve $I_{out}$ from the intermediate portion 62c to the involute point B is indicated by a broken line.

As apparent from the above, the orbiting spiral element 62 from the intermediate portion 62c to the involute point B is made thinner. This does not however raise any problem because a fluid compressing action will not be effected at this portion.

In FIG. 3, the sizes of the individual portions are represented by t, c, a and $R_{or}$, which have also been used in the description of the first embodiment. In the second embodiment, the center O of the shell 52 is displaced by $R_{or}/2+t/2+c/2$ from the center $S_O$ of the involute generating circle S for the fixed spiral element 53 in a direction opposite to the direction toward the base portion 53a of the fixed spiral element 53.

Therefore, the minimum diameter $D_5$ of the shell 52 around the center O or the center of the arc E is expressed as follows:

$$D_5=2(a+t/2+R_{or}/2+c/2)=2a+t+c+R_{or}.$$

If the center O is shifted simply by the above displacement, part of the orbiting spiral element 62 from the intermediate portion 62c to the involute point B interferes with the inner wall of the shell 52.

To prevent the interference, this compressor is designed so that the orbiting spiral element 62 has a maximum diameter $D_6$ expressed below, which has the following relation with the aforementioned minimum diameter $D_5$.

$$D_6=2(a+t/2-R_{or}/2-c/2)=2a+t-(R_{or}+c)$$

$$D_6=D_5-2(R_{or}+c)$$

The center Q of the maximum diameter of the orbiting spiral element 62 is displaced by $R_{or}$ from the center O of the shell 52.

Therefore, a distance $W_5$ between the inner wall of the base portion 53a of the fixed spiral element 53 and the inner wall of the shell 52 is expressed as follows:

$$W_5 + a + R_{or}/2 + t/2 + c/2 = R_{or} - (R_{or}/2 + t/2 + c/2) + a + t + c$$

$$\begin{aligned} W_5 &= R_{or} - (R_{or}/2 + t/2 + c/2) + a + t + c - (R_{or}/2 + t/2 + +c/2 + a) \\ &= 0 \end{aligned}$$

No wasted space therefore exists between the inner wall of the base portion 53a of the fixed spiral element 53 and that of the shell 53. This compressor can therefore reduce the wasted space as follows, as compared with the above-described compressor disclosed in the Japanese publication.

$$W_9-W_5=t+c.$$

Likewise, the minimum diameter of the shell can be reduced as follows.

$$\begin{aligned} D_9 - D_5 &= 2(a + R_{or} + t + c) - 2(a + t/2 + R_{or}/2 + c/2) \\ &= t + c \end{aligned}$$

With t=4 mm and c=1 mm, for example, the minimum diameter of the shell can be reduced by 5 mm. The compressor in the second embodiment is therefore designed to have a smaller diameter and be lighter than the compressor of the first embodiment, further improving the ease of the mounting of the compressor into a vehicle or the like.

What is claimed is:

1. A scroll type fluid compressor comprising:

a housing including a substantially cylindrical shell having an inner wall and an axial center (O);

a fixed spiral element positioned within the shell, the fixed spiral element converging as a substantially involute curve, there being an involute center ($S_O$) of the involute generating circle for the fixed spiral element; and an orbiting spiral element interleaved with the fixed spiral element, the orbiting spiral element converging as a substantially involute curve from a base end portion having a thickness (t), there being a minimum clearance (c) between an outer wall of the base end portion and the inner wall of the shell, the orbiting spiral element being mounted for non-rotational orbital revolving movement relative to the fixed spiral element at an orbital radius $R_{or}$, the orbiting and fixed spiral elements being interleaved so as to form at least one compression chamber therebetween that compresses a fluid as the orbiting spiral element revolves; and wherein the center (O) of the shell is displaced from the involute center ($S_O$) of the fixed spiral element in a direction towards the base end portion of the orbital scroll by a displacement distance (X) in the range of, $$\tfrac{1}{2}R_{or}<X\leqq\tfrac{3}{2}R_{or}+\tfrac{1}{2}(t+c).$$

2. A compressor according to claim 1, wherein a maximum diameter ($D_O$) of the orbiting spiral element is substantially expressed by the equation:

$$(D_O)=2a+t-(c+R_{or})$$

wherein "a" is the distance between the center of the involute generating circle for the orbiting spiral element and the inner wall of the base portion of the orbiting spiral element.

3. A compressor according to claim 1, wherein a maximum inner diameter of the shell ($D_S$) is substantially expressed by the equation:

$$D_S=2a+t+c+R_{or}$$

wherein "a" is the distance between the center of the involute generating circle for the orbiting spiral element and the inner wall of the base portion of the orbiting spiral element.

4. A compressor according to claim 1 wherein the displacement distance (X) is substantially equal to $\frac{1}{2}R_{or}+\frac{1}{2}t$.

5. A compressor according to claim 1 wherein the displacement distance (X) is substantially equal to $\frac{1}{2}R_{or}+\frac{1}{2}(t+c)$.

6. A compressor according to claim 5 wherein a first wrap of the orbital spiral element has a reduced thickness section.

7. A compressor according to claim 1 wherein the clearance c is substantially zero.

8. A scroll type compressor comprising:

a housing including a substantially cylindrical shell having an inner wall and an axial center (O);

a fixed spiral element positioned within the shell, the fixed spiral element converging as a substantially involute curve;

an orbiting spiral element interleaved with the fixed spiral element, the orbiting spiral element converging as a substantially involute curve from a base end portion having a thickness (t), there being a minimum clearance (c) between an outer wall of the base end portion and the inner wall of the shell, the orbiting spiral element being mounted for non-rotational orbital revolving movement relative to the fixed spiral element at an orbital radius $R_{or}$, the orbiting and fixed spiral elements being interleaved so as to form at least one compression chamber therebetween that compresses a fluid as the orbiting spiral element revolves; and a maximum diameter of the orbiting spiral element ($D_O$) is expressed by the relationship:

$$D_S=2a+t-(c+R_{or})$$

an inner diameter of the shell ($D_S$) is expressed by the relationship:

$$D_S=2a+t+c+R_{or},$$

wherein "a" is the distance between the center of the involute generating circle for the orbiting spiral element and the inner wall of the base portion of the orbiting spiral element.

* * * * *

UNITED STATES PATENT AND TRADEMARK OFFICE

CERTIFICATE OF CORRECTION

PATENT NO. : 5,222,883

DATED : June 29, 1993

INVENTOR(S) : T. Fukanuma

It is certified that error appears in the above-indentified patent and that said Letters Patent is hereby corrected as shown below:

Column 3, line 64, change equation to read --$(D_0) = 2a + t - (c + R_{or})$,--.

Column 6, line 16, change "$R_{opr}$" to --$R_{or}$--.

Column 8, line 9, change equation to read --$D_9 - D_5 = 2(a + R_{or}/2 + t + c) - 2(a + t/2 + R_{or}/2 + c/2)$--

Signed and Sealed this

Fifth Day of April, 1994

Bruce Lehman

BRUCE LEHMAN

*Commissioner of Patents and Trademarks*

*Attest:*

*Attesting Officer*